US007793391B2

(12) United States Patent
Sprehe

(10) Patent No.: US 7,793,391 B2
(45) Date of Patent: Sep. 14, 2010

(54) FLANGELESS RECLOSABLE FASTENER

(75) Inventor: Gregory Sprehe, Carbondale, IL (US)

(73) Assignee: Com-Pac International, Inc., Carbondale, IL (US)

( * ) Notice: Subject to any disclaimer, the term of this patent is extended or adjusted under 35 U.S.C. 154(b) by 85 days.

(21) Appl. No.: 11/426,516

(22) Filed: Jun. 26, 2006

(65) Prior Publication Data

US 2006/0230588 A1 Oct. 19, 2006

Related U.S. Application Data

(60) Continuation-in-part of application No. 10/360,184, filed on Feb. 6, 2003, now abandoned, and a division of application No. 09/524,439, filed on Mar. 14, 2000, now Pat. No. 6,576,278.

(51) Int. Cl.
*A44B 19/16* (2006.01)

(52) U.S. Cl. ..... 24/399; 24/585.1; 24/585.12; 24/DIG. 38; 24/DIG. 39; 383/64

(58) Field of Classification Search ..... 24/30.5 R, 24/399, 400, 584.1–585.12, 411, 412, DIG. 38, 24/DIG. 39, DIG. 41, DIG. 50; 383/63, 64, 383/65, 61.2, 61.3
See application file for complete search history.

(56) References Cited

U.S. PATENT DOCUMENTS 2,613,421 A * 10/1952 Madsen ..... 24/399
2,696,032 A * 12/1954 Sander ..... 24/400
2,756,172 A * 7/1956 Kidd ..... 138/147
2,777,181 A * 1/1957 Morner ..... 24/399
2,797,463 A * 7/1957 Dorman et al. ..... 24/399
2,941,027 A * 6/1960 Svec ..... 174/72 A
2,960,561 A * 11/1960 Plummer ..... 174/36

(Continued)

FOREIGN PATENT DOCUMENTS

WO WO 2004/071877 A2 8/2004

(Continued)

OTHER PUBLICATIONS

Supplementary European Search Report for European Patent Application No. 07784485.0, Sep. 11, 2009, 5 pp.

*Primary Examiner*—Robert J Sandy
(74) *Attorney, Agent, or Firm*—Vedder Price PC

(57) ABSTRACT

The present invention includes a baby bottle liner constructed and arranged to fit into a cavity of a baby bottle. The baby bottle liner includes a continuous, profiled, elongated reclosable fastener. The continuous, profiled, elongated reclosable fastener has a first continuous elongated profile strip and a second continuous elongated profile strip. The first continuous elongated profile strip and the second continuous elongated profile strip are dimensioned to provide an airtight and/or watertight seal upon interconnection thereof. The baby bottle liner further comprises an airtight and watertight side seal at each end of the reclosable fastener. Each side seal connects an end of the reclosable fastener to an inside surface of a front wall and an inside surface of a back wall of the liner. The invention also provides a baby bottle with a baby bottle liner and a kit for infant nursing that has a plurality of baby bottle liners. The baby bottle liner can be constructed from a microwavable plastic and also visually indicate that a predetermined safe temperature range has been reached.

15 Claims, 5 Drawing Sheets

U.S. PATENT DOCUMENTS 3,106,941 A * 10/1963 Plummer ..... 138/128
3,115,689 A * 12/1963 Jacobs ..... 24/399
3,117,874 A 1/1964 Horan
3,204,855 A 9/1965 Boynton
3,220,076 A * 11/1965 Ausnit et al. ..... 24/399
3,672,122 A 6/1972 Berger et al.
3,742,950 A 7/1973 Endrody
3,776,408 A 12/1973 Wald
3,790,017 A 2/1974 Fitzpatrick et al.
3,822,806 A 7/1974 Grimes
3,829,938 A 8/1974 Ballin
4,199,845 A * 4/1980 Ausnit ..... 24/399
4,201,299 A 5/1980 Bumgarner et al.
4,238,040 A 12/1980 Fitzpatrick
4,268,938 A * 5/1981 Walchli ..... 53/334
4,339,046 A 7/1982 Coen
4,466,547 A 8/1984 Klittich
4,501,585 A 2/1985 Friedman
4,523,377 A 6/1985 Spletzer et al.
4,558,792 A 12/1985 Cabernock et al.
4,600,104 A 7/1986 Yanase
4,665,557 A 5/1987 Kamp
4,673,383 A 6/1987 Bentsen
4,686,814 A 8/1987 Yanase
4,711,359 A 12/1987 White et al.
4,731,911 A 3/1988 Gould
4,869,912 A 9/1989 McCoy et al.
4,890,935 A * 1/1990 Ausnit et al. ..... 24/399
4,905,694 A * 3/1990 Will ..... 24/400
4,919,983 A 4/1990 Fremin
4,923,701 A 5/1990 VanErden
D310,417 S 9/1990 Herritz
D315,601 S 3/1991 McCoy et al.
5,020,680 A 6/1991 Bale
5,188,461 A * 2/1993 Sorensen ..... 24/399
5,276,950 A 1/1994 Johnson
5,351,369 A * 10/1994 Swain ..... 24/304
5,385,251 A 1/1995 Dunn
5,435,864 A 7/1995 Machacek
5,511,884 A 4/1996 Bruno et al.
5,566,429 A 10/1996 Martinez et al.
5,638,587 A 6/1997 Martinez et al.
5,672,009 A 9/1997 Malin
5,709,915 A 1/1998 Tomic et al.
5,783,027 A 7/1998 Rodenstein
5,794,315 A 8/1998 Crabtree et al.
5,851,071 A 12/1998 Arnell
5,927,855 A 7/1999 Tomic et al.
5,983,466 A * 11/1999 Petkovsek ..... 24/400
5,983,965 A 11/1999 Patrick
6,049,938 A 4/2000 Jimison
6,050,432 A 4/2000 Koehnke
6,167,597 B1 1/2001 Malin
6,185,796 B1 * 2/2001 Ausnit ..... 24/585.1
6,328,082 B1 12/2001 Lafond
6,482,872 B2 11/2002 Downie
6,553,740 B2 4/2003 Delisle
6,553,744 B1 4/2003 Terminella
6,576,278 B1 6/2003 Sprehe
2002/0170156 A1 * 11/2002 Offa-Jones ..... 24/585.1
2003/0093971 A1 5/2003 Terminella
2003/0115832 A1 6/2003 Delisle
2005/0129338 A1 * 6/2005 Sprehe ..... 383/203
2005/0251973 A1 11/2005 Sprehe

FOREIGN PATENT DOCUMENTS

WO WO 2006/034138 A2 3/2006

* cited by examiner

FLANGELESS RECLOSABLE FASTENER

This is a continuation-in-part of U.S. patent application Ser. No. 10/360,184 filed on Feb. 6, 2003, which was a divisional application of U.S. patent application Ser. No. 09/524,439 filed on Mar. 14, 2000 and which is now U.S. Pat. No. 6,576,278 issued on Jun. 10, 2003.

BACKGROUND OF THE INVENTION

This invention generally relates to baby bottle liners, baby bottles, and a baby bottle having a reclosable plastic liner with properties that permit the liner to be reused.

Nursing pouches and disposable baby bottle liners provide a convenient way for nursing, working mothers to provide nourishment and sustenance for newborns and growing babies. Various studies have shown that there are benefits that accrue from breast feeding babies, and should breast feeding be contraindicated, from feeding children appropriate quantities of nutritious liquids and dietary supplements. However, there are various problems associated with the current technology.

Working mothers need a convenient way to store breast milk and then feed their children at appropriate times. Current baby bottle liners do not provide a way to safely store breast milk while minimizing the risk of external contamination of the milk, and internal bacterial growth. One such exemplary prior art baby bottle and liner is disclosed in U.S. Pat. No. 5,385,251 ("'251 patent"). The '251 patent describes a baby bottle liner that provides a reclosable feature at one end of the liner. A serious drawback of this prior art patent involves the risk of contamination of the contents of the liner at the ends of the reclosable fastener and through the fastener itself. The liner of the '251 patent permits contamination by microbes through the sides of the fastener which are open to the environment. Further, the fastener itself permits air and water to enter the inside of the liner and contaminate the contents thereof. Consequently, a nursing mother may be feeding her child breast milk that may be contaminated with microbes which could cause serious gastrointestinal problems for the child.

Further, the prior art does not solve the problem of how to place an airtight and watertight reclosable string fastener on a liner that is of a size of most liners for baby bottles. Conventional baby bottle liners are generally narrow in width. Hence, placement and sealing of a reclosable fastener onto a liner of narrow width is also a serious problem.

Similarly, U.S. Design Pat. No. 315,601, U.S. Pat. Nos. 3,204,855, 3,672,122, 3,790,017, 3,822,806, 4,238,040, 4,339,046, 4,466,547, 4,501,585, 4,600,104, and 4,896,912 are designed for one time use, yet have a number of serious drawbacks. If the child does not consume the entire quantity of milk held in the liner, the milk must be transferred to another container for storage thereof since the liners were not created to store the unused portion of the milk in a substantially sterile condition. Another drawback of these prior art patents includes that lack of the ability to reuse the liner holder for another beverage. The contents of the liner that are initially held in the liner must be emptied, and the liner disposed of if the holder is to be reused.

Hence, there exists a need to solve the problems in the art that are articulated above.

SUMMARY OF THE INVENTION

Accordingly, it is an object of the invention to overcome the shortcomings of the prior art, and in doing so provide a baby bottle liner constructed and arranged to fit into a cavity of a rigid, conventional baby bottle or holder. The baby bottle liner has a continuous, profiled, elongated reclosable fastener sealed to the inside walls of the liner. The continuous, profiled, elongated reclosable fastener includes a first continuous elongated profile strip and a second continuous elongated profile strip. The first continuous elongated profile strip and the second continuous elongated profile strip are sized and dimensioned to provide an airtight and/or watertight seal upon interconnection thereof.

It is a further object of the invention to provide a baby bottle liner that has an airtight and/or watertight side seal at each end of the reclosable fastener. Each of the side seals connects an end of the reclosable fastener to an inside surface of a front wall and an inside surface of a back wall of the liner.

It is yet a further object of the invention to provide a baby bottle liner that includes a gussetted bottom, and an airtight and watertight seal at the gussetted bottom.

It is another object of the invention to provide a baby bottle liner in which the first continuous elongated profile strip and the second continuous elongated profile strip each have at least two hooks thereon. The hooks on the first continuous elongated profile strip, or optionally the hooks on the second continuous elongated profile strip, are adjacent to each other. In a variant of the invention, at least one of the hooks is at an end of the first continuous elongated profile strip. A second hook of the two hooks is located proximal to the hook at the end of the first continuous elongated profile strip.

It is yet another object of the invention to provide a baby bottle liner that includes a plurality of continuous recesses along a length of each of the profile strips. At least one of the recesses is dimensioned to resealably mate with one of the hooks, in one embodiment of the invention. In yet another embodiment of the invention, at least two of the continuous recesses are dimensioned to resealably mate with the hooks.

It is yet a further object of the invention to provide a baby bottle liner in which at least one continuous recess on each of the profile strips is not dimensioned to mate with the hooks, and, in a variant, provide at least one protuberance along a length of each of the profile strips dimensioned to fit securely in the one continuous recess on each of the profile strips not dimensioned to mate with the hooks.

In one variant, at least one of the hooks on the first continuous elongated profile strip is located near the center of the profile strip. In another variant of the invention the hooks are substantially symmetrically distributed on two sides of a center axis of the profile strip.

In yet another embodiment, it is an object of the invention to provide a reclosable fastener that has a plurality of ridges on a back side of each of the profile strips.

Another object of the invention is to provide a baby bottle liner that has infant formula therein. In this variant and other variants of the invention, a top end seal is placed above the reclosable fastener to keep the infant formula hermetically sealed within the liner.

Yet a further object of the invention is to provide a baby bottle with the baby bottle liner described herein, and a kit for infant nursing comprising a plurality of baby bottle liners according to the invention. The kit optionally includes a baby bottle, and/or infant formula.

Another object of the invention includes a baby bottle liner that is constructed from a microwavable plastic, a food grade microwavable plastic, and/or a microwave safe plastic.

In yet another embodiment of the invention, the baby bottle liner includes an additive that changes color when the temperature of the contents of the liner increases or reaches a predetermined temperature range.

It is another object of the present invention to solve these and other problems in the art, and to serve a market that demands hundreds of millions of reclosable plastic baby bottle liners annually. The objects and features of the present invention, other than those specifically set forth above, will become apparent in the detailed description of the invention set forth below and in the drawings.

DETAILED DESCRIPTION OF THE INVENTION

Figure 1:
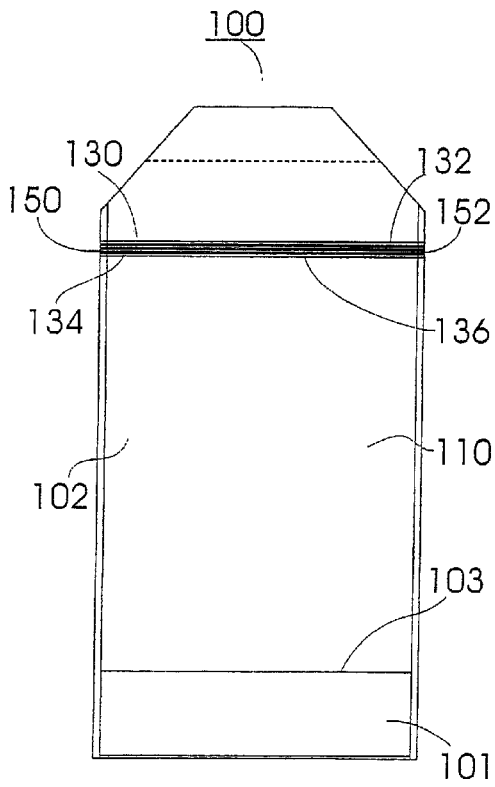
FIG. 1 is a front plan view of a reclosable baby bottle liner of the present invention.
Figure 2:
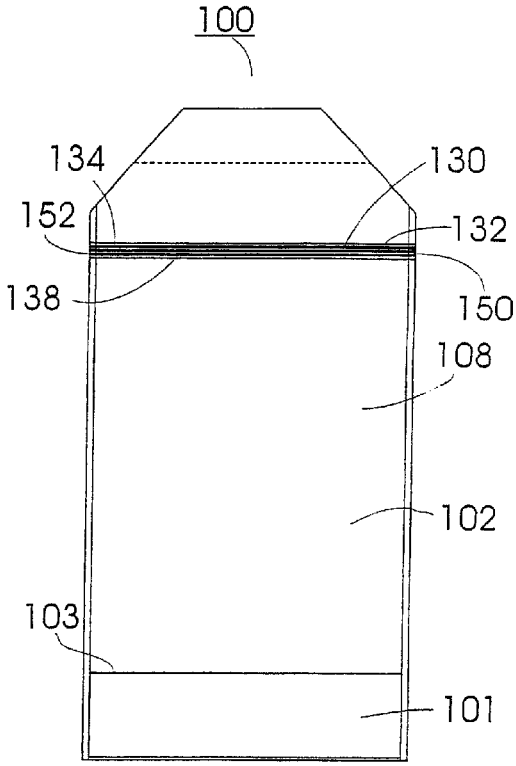
FIG. 2 is a back plan view of the liner of FIG. 1.
Figure 6:
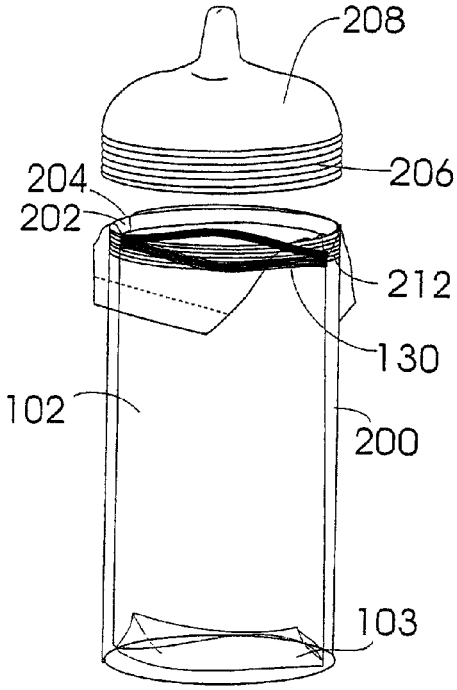
FIG. 6 is a front perspective view of a kit of the present invention having a baby bottle with the baby bottle liner of FIG. 1 therein.

FIG. 1 is a front plan view of reclosable baby bottle liner 100. Liner 100 includes a liner body 102. The baby bottle liner 100 is constructed and arranged to fit into cavity 202 of baby bottle 200 (FIG. 6). It will be appreciated that baby bottle 200 can be made from any suitable material including substantially rigid plastic materials. Baby bottle 200 can have one or two open ends disposed at opposite ends of the baby bottle 200. Liner 100 is constructed to fit over top opening 204 of baby bottle 200, such that cap 206 having nipple 208 can be screwed onto the baby bottle 200 at threads 212. Liner 100 is of a sufficient length L and circumference C such that the portion of the liner 100 having continuous, profiled, elongated reclosable fastener 130 fits over the outside surface 210 of baby bottle 100 such that the liner body is nestled between cap 206 and threads 212. While the variant of the invention shown in the figures illustrates threads 212 mated with cap 206, various types of mounting and securing methods can be used other than those described herein. In another variant, cap 206 is placed directly over reclosable fastener 130.

Continuous, profiled, elongated reclosable fastener 130 includes first continuous elongated profile strip 136 and a second continuous elongated profile strip 138. An important aspect of the invention is the fact that the first continuous elongated profile strip 136 and the second continuous elongated profile strip 138 are dimensioned to provide an airtight and watertight seal upon interconnection thereof. The airtight and/or watertight seal provide the important function of keeping foreign material including bacteria, molds, and viruses from entering the interior of liner 100. Further, this seal starves any bacteria or other microbes inside the contents of the liner of oxygen, thus destroying the ability to replicate exponentially. Hence, the risk of deadly contamination of the milk in the liner is greatly reduced. Various types and configurations of reclosable fasteners can be used with the present invention as long as they provide the functionality of being airtight and/or water tight.

Figure 3:
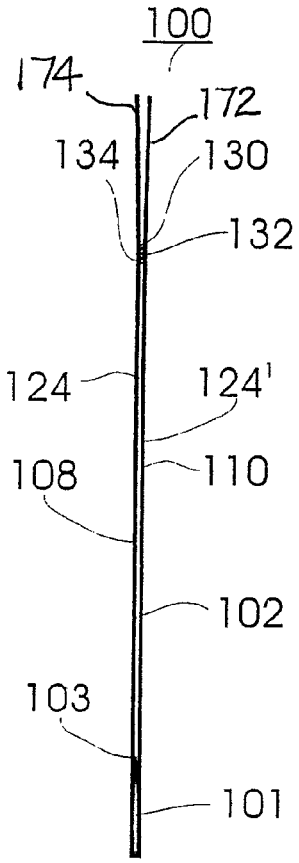
FIG. 3 is a side cross sectional view of the liner of FIG. 1.
Figure 4:
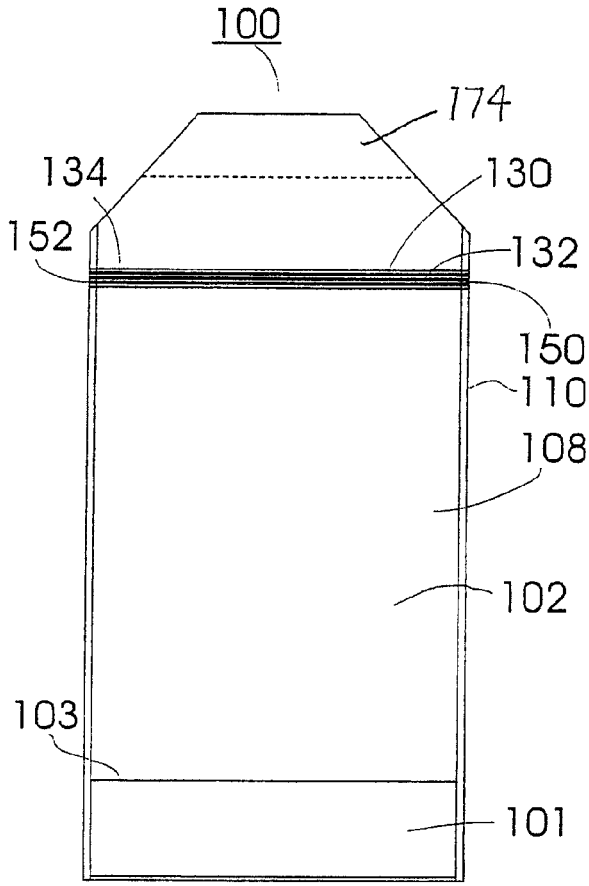
FIG. 4 is a front plan view of the liner of FIG. 1 through a side seal of the liner.

Also important to the invention is that baby bottle liner 100 includes airtight and/or watertight side seals 150, 152 at each end of said reclosable fastener, each said side seal 150, 152 connects an end of said reclosable fastener to an inside surface of a front wall 108 and an inside surface of a back wall 110 of liner 100. At each end 132, 134 of the reclosable fastener assembly 130 is an airtight and watertight side seal 150, 152. Each side seal 150, 152 connects end 132, 134 of the reclosable fastener assembly 130 to an inside surface 124 of front wall 108 and an inside surface 124 of back wall 110 (as seen in FIG. 3). Any of the seals described herein can be made by a variety of devices including heat sealers, ultrasonic sealers, and other devices known in the art. The seals also may be made with a food grade adhesive.

In one variant of the invention, baby bottle liner 100 includes gusseted bottom 101, and an airtight and/or watertight seal 103 at gusseted bottom 101. The invention also contemplates placement of side gussets on liner 100 (not shown)

As stated above, liner 100 includes reclosable fastener 130. Reclosable fastener assembly 130 includes two ends 132, 134. Between ends 132, 134, a first continuous elongated profile strip 136 is releasably interlocked with a second continuous elongated profile strip 138. It is appreciated that first continuous elongated profile 136 and the second continuous elongated profile 138 can have any type of protruding male and female members which when interlocked provide an airtight and/or watertight seal.

Figure 9:
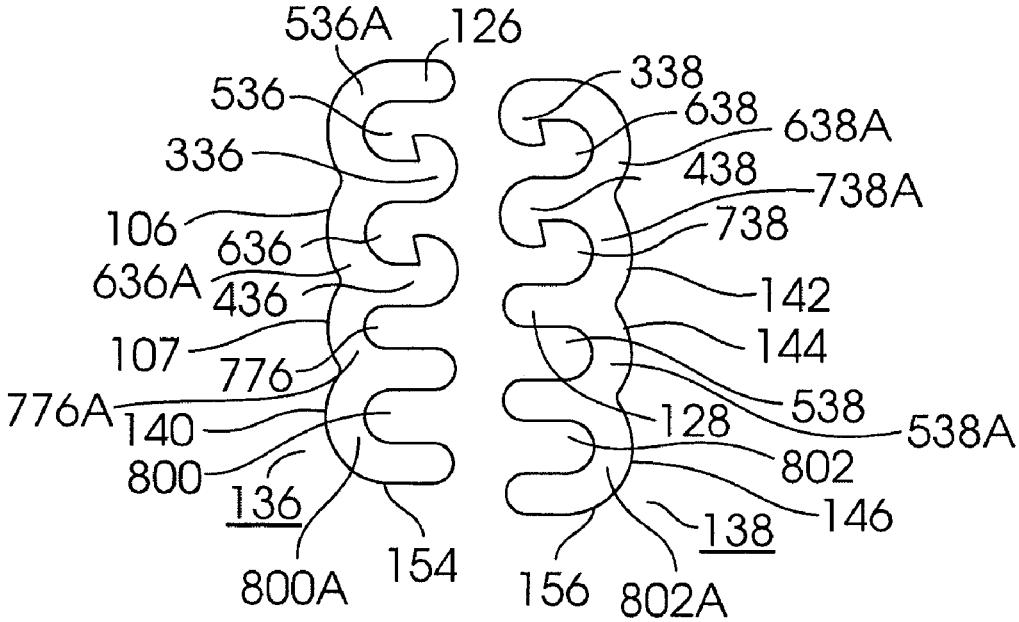

In a preferred embodiment of the invention, a particular type of reclosable fastener 130 has been found to provide a particularly durable airtight/water tight seal for use in the present invention. Fastener 130 includes first continuous elongated profile strip 136 and second continuous elongated profile strip 138 which each have at least two hooks 336, 436, 338, 438 thereon (as seen in FIG. 9). First continuous elongated profile strip 136 has hooks 336, 436. Second continuous elongated profile strip 138 has hooks 338, 438 hooks thereon. While only two pairs of hooks 336, 436, 338 and 438 are constructed and arranged on profiles 136, 138 in the variant shown it is appreciated that a greater or lesser number of hooks can be used as desired, with a corresponding increase in width of the strips 136, 138.

In the embodiment shown in FIG. 9, the fastener has a first continuous, elongated profile strip 136 having a plurality of adjacent and contiguous C-shaped closure elements 536A, 636A, 776A, 538A, 638A, 738A, 800A and 802A. Each of the closure elements 536A, 636A, 776A, 538A, 638A, and 738A has both a curved interior and exterior surface. "C-shaped" for purposes of this invention is defined as the letter "C" having a curved interior and exterior surface.

Preferably, hooks 336, 436 on first continuous elongated profile strip 136 are adjacent to each other. Optionally, hooks 338, 438 on second continuous elongated profile strip 138 are also adjacent to each other in one variant of the invention. As shown in FIG. 9, at least hook 336 is at an end of first continuous elongated profile strip 136. Second hook 436 is located proximal to hook 336.

In one variant of the invention, first continuous elongated profile strip 136 has a plurality of continuous recesses 536, 636, 776 and 800 along a length of strip 136 (FIG. 9). Second continuous elongated profile strip 138 has a plurality of continuous recesses 538, 638, 738 and 802 along a length of strip 138. Of course, it is appreciated that any number of recesses can be created along strips 136, 138, including but not limited to more than three recesses and less than three recesses, with a corresponding increase/decrease in corresponding hooks and other members. In one variant of the invention, at least one of the recesses is dimensioned to resealably mate with one of the hooks. As illustrated in FIG. 9, recesses 536 and 636 are substantially congruent to hooks 338, 438 such that when hooks 338, 438 are releasably interlocked into recesses 536, 636 a secure water tight and/or airtight seal is created. Similarly, recesses 638 and 738 are substantially congruent to hooks 335, 436 such that when hooks 335, 436 are releasably interlocked into recesses 638, 738 a secure water tight and/or airtight seal is also created. It is appreciated that while the geometry and arrangement of the various recesses and hooks described herein generally relates to a hook and a substantially congruent recess to the hook, a variety of suitable geometries or configurations of the male members and female members are disclosed subject only to the condition that the seal made when the profiles are interlocked is airtight and/or water tight. It is further appreciated that the present invention provides a reclosable fastener with a plurality of airtight and/or watertight seals between corresponding members of the profile strips 136, 138.

It is further appreciated that, preferably, at least two continuous recesses 536, 636 are dimensioned to resealably mate with hooks 338, 438, and/or at least two continuous recesses 638, 738 are dimensioned to resealably mate with hooks 336, 436.

In another variant of the invention, at least one continuous recess on each respective profile strip is not dimensioned to mate with a respective hook, but rather dimensioned to tightly fit into a recess that is substantially congruent to a profile member. It is appreciated that when member 126 is inserted into recess 538, the tight fit between member 126 and recess 538 also creates an additional substantially water tight and/or airtight fit. The interaction between the other recesses and members causes a similar result with the combination of the interaction of the various hooks, recesses, and members creating a substantially leak-proof failsafe seal. Of course, it is further appreciated that while the geometry of the members is as shown in the FIGS. 8 and 9, any type of geometry or configuration can be used, e.g. a rectangular geometry, a triangular geometry, etc. The profile of the present invention provides for at least one protuberance along a length of each profile strip 136, 138 dimensioned to fit securely in one of the continuous recesses on each profile strip 136, 138 not dimensioned to mate with the hooks.

As further seen in FIG. 9, a plurality of ridges 106, 107, 140, 142, 144, 146 are located on back sides 154, 156 of each of profile strips 136, 138. Ridges 106, 107, 140, 142, 144, 146 provide a suitable way to obtain an airtight and/or water tight seal of back sides 154, 156 to inside surface 124 of the liner body 102 at front wall 108 and back wall 110. Ridges 106, 107, 140, 142, 144, are curved rather than rectangular in order to facilitate the air-tight and water-tight seal on the backsides 154 and 156 of profile strips 136 and 138 to inside surface 124 of the front wall 108 and the back wall 110.

As shown in FIG. 9, at least one of hooks 338, 438 on first continuous elongated profile strip 138 is located near center axis C of profile strip 138. In this variant of the invention, one or more hooks 338, 438 are substantially symmetrically distributed on two sides of center axis C of profile strip 138. Having the various hooks, recesses, and members constructed and arranged as described herein allows for an airtight and/or watertight seal.

Figure 5:
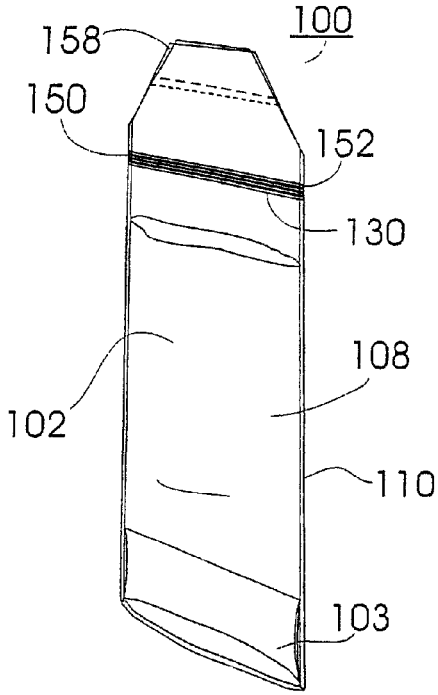
FIG. 5 is a front perspective view of the baby bottle liner of FIG. 1 including infant formula and a top end seal above the reclosable fastener.

Optionally, baby bottle liner 100 can also have infant formula or other nutritional supplement or drink within liner body 102 (FIG. 5). In this scenario, the airtight and/or watertight seal formed with reclosable fastener 130 is particularly helpful as the contents are hermetically sealed within the liner body 102 until they are ready for use. Top end seal 158 can also optionally be added above reclosable fastener 130 to reduce the risk of contamination of the contents of the liner body 102.

Figure 7:
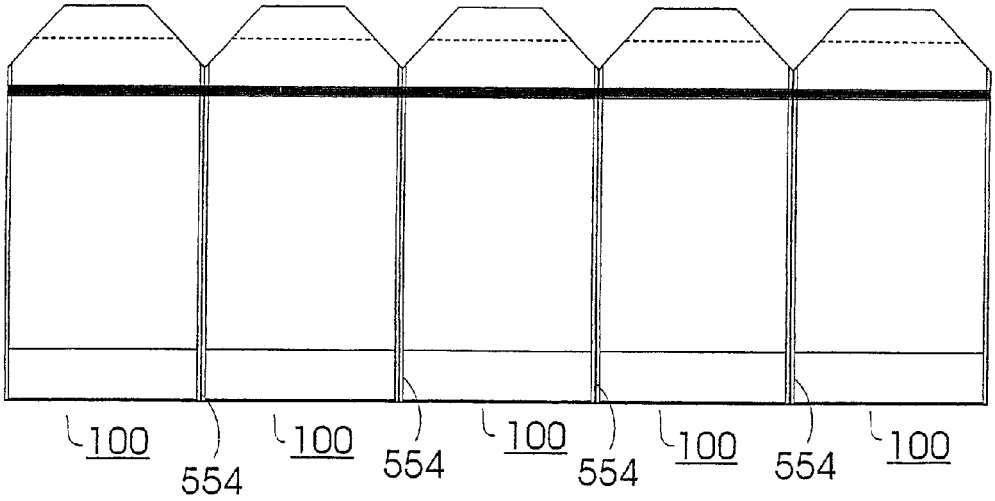
FIG. 7 is a front perspective view of a plurality of chain of baby bottle liners according to FIG. 1.

It is appreciated that liner 100 of the present invention is used with baby bottle 200 and located within a cavity 202 therein (FIG. 6). In addition to being used with baby bottle 200, the present invention provides kit 550 for infant nursing which is composed of a plurality of baby bottle liners 100 (FIG. 7). Each baby bottle liner 100 can be dispensed from a roll of baby bottle liners 100 by being removably connected to one another and detached from one another by a frangible connection between each respective liner 100 such as a perforation 100A or other suitable means. Alternatively, the kit 100 can also be composed of individual liners 100 which can be packed within a box or other appropriate container (not shown) such that a nursing mother can readily have access to liners 100 as the need arises. In another variant, each individual liner 100 or a plurality of liners 100 can be hermetically sealed within a non-reclosable plastic bag (not shown) that may be torn open as the need arises. Kit 550 can also include formula, nutritional drinks, baby bottle nipples, one or more baby bottles 200 of various sizes and/or liners 100 of various sizes, sized, arranged and constructed with kit 550 for ease of access and use with respective baby bottles 200.

Yet another variant of the invention provides liner 100 that is constructed of a food grade microwavable plastic or a microwavable coating(s) that permits the contents of the liner body 102 to be placed in a microwave for re-heating of the contents to a suitable temperature. It is appreciated that this feature of the invention permits several of the most common problems associated with infant nursing to be solved, e.g. re-use and re-heating of mother's milk or infant formula. It is also appreciated that the plastic is chosen to eliminate or minimize any leaching that may occur. Various types of food grade, microwavable plastics are known and commercially available in the industry, but they have not been used with bottle liners as in the present invention. One such suitable microwavable material is a film comprising Kraton™ polyolefin block co-polymers that are commercially available from Shell Chemical Products. Materials made with or comprising Kraton™ polymers also have the additional advantage that they are steam sterilizable or sterilizable by other conventional methods.

The liner 100 also optionally comprises an additive that is extruded with liner 100. The additive changes color when the temperature of the contents of the liner increases or turns a predetermined color when the contents of the liner 100 are at a suitable temperature. Liner 100 may also optionally have a temperature indicator or temperature range indicator associated with the liner 100, e.g. connected thereto or placed as a strip on or in liner 100 that changes color when the temperature of the contents of the liner increases or reaches a predetermined desirable temperature or temperature range. This feature solves the common problem of providing the infant formula or mother's milk at an appropriate temperature that is neither too hot nor too cold for the child. This feature of the invention permits the temperature of the contents of the liner 100 to be visually determined prior to infant nursing.

Figure 8:
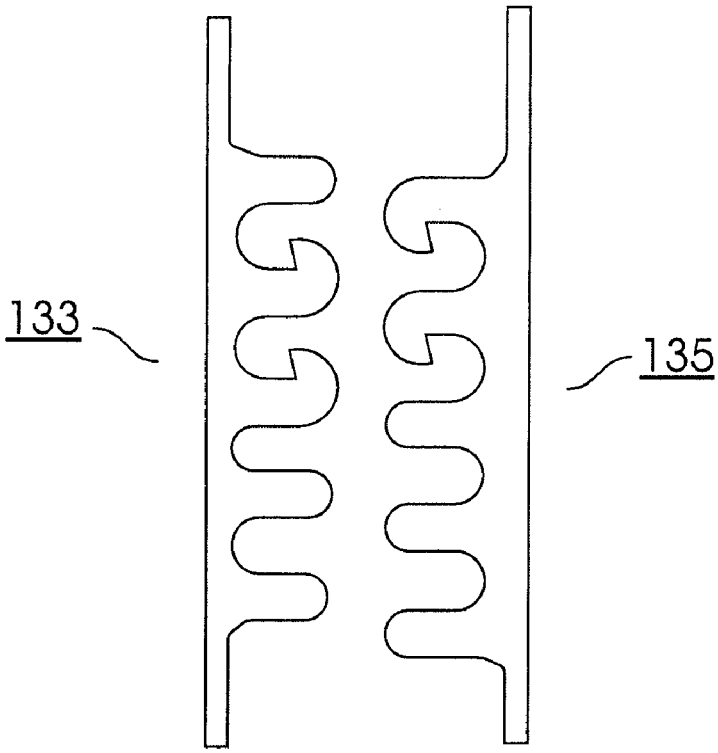
FIG. 8 is a side cross sectional view of the baby bottle liner of FIG. 1 having a continuous, profiled, elongated reclosable fastener that is a flanged reclosable fastener; and, FIG. 9 is a side cross sectional view of a reclosable fastener used with the baby bottle liner of the present invention.

While the embodiment of the invention shown in FIG. 9 illustrates a reclosable fastener 130 that is a string zipper, it is also appreciated that reclosable fastener 130 can also include a flanged reclosable fastener 131 (FIG. 8). Flanged reclosable fastener 130 comprises at least two flanges 133, 135. Flanges 133, 135 are sealed to front wall 108 and/or back wall 110 of baby bottle liner 100 with airtight and/or watertight flange seals 137, 139. It is appreciated that by providing flanges 133, 135, the problems associated with sealing an irregularly shaped surface, e.g. a zipper profile, to a smooth surface are eliminated. The flange 133 and flange 135 provide a substantially smooth, planar and uniform surface to which to seal the inside surface 124 and walls 108, 110 of liner body 102. To improve the appearance and air and water-tightness of liner 100, it is preferred that the length L of the reclosable fastener assembly 130 is less than the width W of back wall 110 (FIG. 1).

In a variant of the invention, liner 100 includes a frangible access 155 (FIG. 5). Access 155 can take many forms including a crease line, a score line, or a plurality of perforations. Preferably, access 155 is substantially parallel to the reclosable fastener assembly 130 or access 155 may be sinusoidally shaped for aesthetic purposes. Removal of access 155 exposes the releasable fastener assembly 130 and provides access to the reclosable fastener 130. One feature of the invention is that frangible access 155 is located both on the front wall 108 and on the back wall 110 of the liner body 102 adjacent the reclosable fastener assembly 130 and above the top end seal 158 (FIG. 5). In a preferred embodiment, frangible access 155 comprises a plurality of perforations 157.

The film from which liner body 102 is constructed can be made from any suitable material, but is preferably made from a polymeric material as long as it is food grade and compatible with the contents of the liner 100. The film is folded and sealed such that bottom gussets 101 are created in a conventional manner. Optionally, side gussets (not shown) are also added to liner body 102. It is appreciated that the gussetting feature increases the overall carrying capacity of the liner 100 and makes the bottle 200 with liner 100 generally more stable where the entire bottle is filled with formula and the like.

The seals used in the present invention can be made using conventional sealing techniques, which include by way of example heat sealing, ultrasonic sealing, adhesive sealing, etc. To aid in the formation of the airtight and/or watertight seals used in the present invention, it is appreciated that the length L of the reclosable fastener 130 is less than the length of front wall 108 and/or back wall 110 that form liner body 102.

Figure 10:
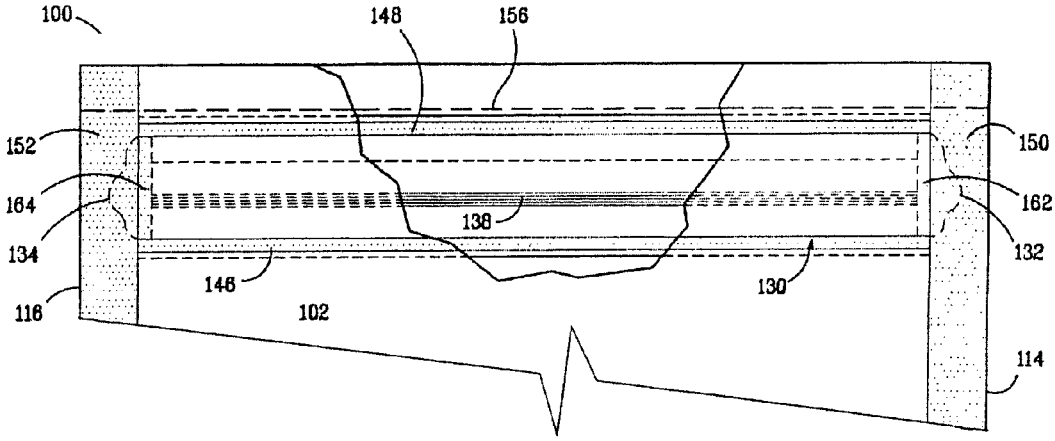
FIG. 10 is a front partial cross sectional plan view of the baby bottle liner of FIG. 1 including the top end seal above the reclosable fastener.

As seen in FIG. 10, side seals 150, 152 are placed at each end of the reclosable fastener assembly 130. Side seals 150, 152 provide an airtight and/or watertight seal between the inside surface 124 of film 112 and reclosable fastener assembly 130. Each of the side seals 150, 152 connects an end 132, 134 of the reclosable fastener 130 to the inside surfaces 124, 124' of the rectangular sheet of film inwardly of liner edges 114, 116 of the liner body 102 thereby preventing air or liquids from entering or leaving the liner through the ends 132, 134 of the reclosable fastener assembly 130. Preferably, prior to sealing of reclosable fastener 130 to front wall 108 and/or back wall 110, the ends 132, 134 of reclosable fastener 130 are splotched or compression molded. Splotching of reclosable fastener ends 132, 134 creates substantially flattened ends 162, 164 which facilitate the formation of the airtight and/or watertight seals of the invention. It is appreciated that these side seals substantially reduce the risk of contamination of the contents of bag liner body 102.

It is appreciated that reclosable fastener assembly 130 can take many forms. Preferably, profile strips 136, 138 are each made from a single, extruded, flexible polymeric material. Further, tearoff tabs 172, 174 can be added to walls 108, 110 above to assist in placing of liner 100 in bottle 200.

Properly feeding, locating and sealing reclosable fastener 130 at predetermined locations on the material from which the liner body 102 is made are important aspects of the invention. Machines commercially available from Z-Patch, Inc. of Carbondale, Ill. are reliable and capable of repeatedly performing the steps referred to in the method described above with high throughput and with low cycle times.

While only a few, preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

I claim:

1. A flangeless, reclosable fastener comprised of:

(a) a first elongated fastener strip, and a second elongated fastener strip, said first elongated fastener strip being formed of a plurality of adjacent and contiguous, C-shaped closure elements, each of said C-shaped closure elements having an opening that faces a first direction, said openings defining a first side of said first elongated fastener strip, an upper and lower extent of the adjacent and contiguous C-shaped closure elements defining a width of said first elongated fastener strip, at least one of said C-shaped closure elements being formed to have a hook-shaped protuberance that is shaped and sized to engage a complementary recess in the second elongated fastener strip;

(b) said second elongated fastener strip being formed of a plurality of adjacent and contiguous, C-shaped closure elements, each of said C-shaped closure elements having an opening facing a second direction that is opposite said first direction, said openings of said plurality of C-shaped closure elements defining a first side of said second fastener strip, an upper and lower extent of the plurality of contiguous C-shaped closure elements defining a width of said second elongated fastener strip, at least one of said C-shaped closure elements being formed to have a hook-shaped protuberance that is shaped and sized to engage a complementary recesses in said first elongated fastener strip, said first and second fastener strips having recesses that are substantially congruent to the hook-shaped protuberances;

(c) when said first elongated fastener strip and second elongated fastener strips are engaged, the upper extent of said C-shaped closure elements of said first elongated fastener strip and the lower extent of said C-shaped closure elements of said second elongated fastener strip define the width of said flangeless, reclosable fastener;

(d) the first and second elongated fastener strips having back sides with curved ridges to facilitate a substantially airtight and watertight seal to an inside surface of a front wall and a back wall of bag containing the reclosable fastener; and (e) wherein the engaged hook-shaped protuberances and recesses in the first elongated fastener strip and in the second elongated fastener strip are sized, dimensioned, and arranged to provide a substantially airtight and substantially watertight seal.

2. The flangeless, reclosable fastener of claim 1, wherein the substantially C-shaped closure elements of said first elongated fastener strip form a recess in said first elongated fastener strip into which a hook-shaped protuberance can be received.

3. The flangeless, reclosable fastener of claim 1, wherein the substantially C-shaped closure elements of said second elongated fastener strip form a recess in said second elongated fastener strip into which a hook-shaped protuberance can be received.

4. The flangeless, reclosable fastener of claim 1, wherein adjacent and contiguous C-shaped closure elements of said first elongated fastener strip form a plurality of ridges on a second curved side of said first elongated fastener strip that is opposite of said first side of said first elongated fastener strip, said ridges for use in attaching the second side of said first elongated fastener strip to a first sheet of plastic film.

5. The flangeless, reclosable fastener of claim 4, wherein adjacent and contiguous C-shaped closure elements of said second elongated fastener strip form a plurality of ridges on a second curved side of said second elongated fastener strip that is opposite the first side of said second elongated fastener strip, said ridges for attaching the second side of said second elongated fastener strip to a second sheet of plastic.

6. The flangeless, reclosable fastener of claim 1, in which each of said elongated fastener strips have at least one, hook-shaped protuberances formed on at least one, C-shaped closure elements.

7. The flangeless, reclosable fastener of claim 6, wherein a second hook-shaped protuberance of said plurality of hook-shaped protuberances is located proximal to a first hook-shaped protuberance at an end of said first elongated fastener strip.

8. The flangeless, reclosable fastener of claim 1, further comprising at least one continuous recess on each said elongated fastener strip, not dimensioned to mate with a hook-shaped protuberance.

9. The flangeless, enclosable fastener of claim 1, in which at least one of said hook-shaped protuberances on said first elongated fastener strip is located near the center of said profile strip.

10. The flangeless, reclosable fastener of claim 1, in which two said hook-shaped protuberances are substantially symmetrically distributed on two sides of a center axis of said elongated fastener strips.

11. The flangeless, reclosable fastener of claim 1, wherein said first elongated fastener strip and said second elongated fastener strip are formed of at least one of: (a) a microwaveable plastic material; (b) a food-grade, microwaveable plastic material.

12. The flangeless, reclosable fastener of claim 1, wherein at least one of said first elongated fastener strip and second elongated fastener strip are formed of sterlizable polyolefin block co-polymer.

13. The flangeless, reclosable fastener of claim 1, wherein at least one of said first elongated fastener strip and second elongated fastener strip are formed from the group comprising: polyolefins, including polyethylene and polypropylene, and polyolefin block co-polymers.

14. The flangeless, reclosable fastener of claim 1, wherein at least one of the distal ends of the first elongated fastener strip and the second elongated fastener strip are formed with a compression seal.

15. A flangeless, reclosable fastener comprised of:

(a) a first elongated fastener strip, and a second elongated fastener strip, said first elongated fastener strip being formed of a plurality of adjacent and contiguous, C-shaped closure elements, each of said C-shaped closure elements having an opening that faces a first direction, said openings defining a first side of said first elongated fastener strip, an upper and lower extent of the adjacent and contiguous C-shaped closure elements defining a width of said first elongated fastener strip, at least one of said C-shaped closure elements being formed to have a hook-shaped protuberance that is shaped and sized to engage a complementary recess in a second elongated fastener strip;

(b) said second elongated fastener strip being formed of a plurality of adjacent and contiguous, C-shaped closure elements, each of said C-shaped closure elements having an opening facing a second direction that is opposite said first direction, said openings of said plurality of C-shaped closure elements defining a first side of said second fastener strip, an upper and lower extent of the plurality of contiguous C-shaped closure elements defining a width of said second elongated fastener strip, at least one of said C-shaped closure elements being formed to have a hook-shaped protuberance that is shaped and sized to engage a complementary recesses in said first elongated fastener strip, said first and second fastener strips having recesses that are substantially congruent to the hook-shaped protuberances;

(c) when said first elongated fastener strip and second elongated fastener strips are engaged, the upper extent of said C-shaped closure elements of said first elongated fastener strip and the lower extent of said C-shaped closure elements of said second elongated fastener strip define the width of said flangeless, reclosable fastener; and (d) wherein the engaged hook-shaped protuberances and recesses in the first elongated fastener strip and in the second elongated fastener strip are sized, dimensioned, and arranged to provide an airtight and watertight seal, said reclosable fastener profile having a first end and a second end, said first end and said second end of said reclosable fastener assembly each having an air- and water-tight side seal.

* * * * *